US011149998B2

(12) United States Patent
Vianello et al.

(10) Patent No.: US 11,149,998 B2
(45) Date of Patent: Oct. 19, 2021

(54) APPARATUS FOR MAINTAINING A MOTOR VEHICLE AIR CONDITIONING SYSTEM PROVIDED WITH CARBON DIOXIDE AND OPERATING METHOD THEREOF

(71) Applicant: TEXA S.P.A., Monastier di Treviso (IT)

(72) Inventors: Bruno Vianello, Roncade (IT); Stefano Meneghel, Monastier di Treviso (IT)

(73) Assignee: TEXA S.P.A., Monastier di Treviso (IT)

( * ) Notice: Subject to any disclaimer, the term of this patent is extended or adjusted under 35 U.S.C. 154(b) by 0 days.

(21) Appl. No.: 16/303,964

(22) PCT Filed: May 26, 2017

(86) PCT No.: PCT/IB2017/053119
§ 371 (c)(1),
(2) Date: Nov. 21, 2018

(87) PCT Pub. No.: WO2017/203481
PCT Pub. Date: Nov. 30, 2017

(65) Prior Publication Data

US 2020/0318879 A1 Oct. 8, 2020

(30) Foreign Application Priority Data

May 26, 2016 (IT) ..... 102016000054482

(51) Int. Cl.
*F25B 45/00* (2006.01)
*F25B 9/00* (2006.01)

(52) U.S. Cl.
CPC ..... *F25B 45/00* (2013.01); *F25B 9/008* (2013.01)

(58) Field of Classification Search
CPC ..... F25B 2345/002; F25B 2345/003; F25B 45/00
(Continued)

(56) References Cited

U.S. PATENT DOCUMENTS 4,223,803 A * 9/1980 Pearson ..... F17B 1/26 222/3
4,609,328 A * 9/1986 Cirrito ..... F04F 5/00 417/158
(Continued)

FOREIGN PATENT DOCUMENTS

EP 2 051 030 A2 4/2009
GB 2 504 280 A 1/2014

*Primary Examiner* — Filip Zec
(74) *Attorney, Agent, or Firm* — Leason Ellis LLP

(57) ABSTRACT

Maintenance apparatus of an air conditioning system mounted on a motor vehicle. The maintenance apparatus comprises: two external ducts, a discharging circuit, which is connected to the ducts to receive the carbon dioxide contained in the air conditioning system at a first pressure and a first flow rate and is structured so as to discharge the carbon dioxide received into the environment, a measuring apparatus, which is configured so as to measure the amount of carbon dioxide that passes through the discharging circuit, and a pressure and flow rate reducing device, which is structured so as to reduce the first pressure and the first flow rate of the carbon dioxide to the be measured to a second predetermined pressure and to a second predetermined flow rate, respectively.

15 Claims, 3 Drawing Sheets

(58) Field of Classification Search
USPC ..... 62/77, 149, 292
See application file for complete search history.

(56) References Cited

U.S. PATENT DOCUMENTS

| | | | | |
|---|---|---|---|---|
| 7,328,606 | B2 * | 2/2008 | Nakamura | G01M 15/102 73/114.71 |
| 7,591,982 | B2 * | 9/2009 | Guyomarc'h | C02F 11/06 110/210 |
| 7,762,089 | B2 * | 7/2010 | Govekar | F25B 9/008 62/77 |
| 8,100,065 | B2 * | 1/2012 | Liu | F23J 1/02 110/216 |
| 2006/0010889 | A1 | 1/2006 | Meeker | |
| 2015/0323233 | A1 * | 11/2015 | Kerschenbauer | B60H 1/00585 62/77 |
| 2016/0123641 | A1 | 5/2016 | McMasters | |
| 2017/0314830 | A1 * | 11/2017 | Klemen | F25B 45/00 |

* cited by examiner

APPARATUS FOR MAINTAINING A MOTOR VEHICLE AIR CONDITIONING SYSTEM PROVIDED WITH CARBON DIOXIDE AND OPERATING METHOD THEREOF

CROSS-REFERENCE TO RELATED PATENT APPLICATIONS

This application is a U.S. National Phase Application under 35 U.S.C. § 371 of International Patent Application No. PCT/IB2017/053119, filed May 26, 2017, which claims the priority of Italian Application No. 102016000054482, filed May 26, 2016, which is incorporated by reference as if expressly set forth in its entirety herein.

TECHNICAL FIELD

The invention relates to an apparatus for maintaining a motor vehicle air conditioning system provided with carbon dioxide and to an operating method thereof.

In particular, the invention concerns a maintenance apparatus provided with a system for measuring the total amount of carbon dioxide discharged from an air conditioning system mounted on a motor vehicle, such as for example an automotive vehicle—car, truck, bus or the like—to which explicit reference will be made in the description below without because of this loosing in generality.

BACKGROUND ART

It is known that in recent years some car manufacturers have decided to use, in the air conditioning systems mounted on board their vehicles, a new type of cooling fluid, which substantially consists of carbon dioxide and is indicated with "R744".

As a matter of fact, it has been proven that, unlike the most common cooling fluids currently used, such as, in particular, the cooling fluids known as "R1234yf" and "R134a", carbon dioxide—namely the cooling fluid known as R744—allows manufacturers to diminish or even reduce to zero the environmental impact, at least in terms of dangerous repercussions of the fluid on the greenhouse effect. Owing to this, during the maintenance of an air conditioning system of the type described above, carbon dioxide does not necessarily need to be collected and recovered in suitable tanks, which, on the other hand, is compulsory in case of the traditional cooling fluids "R1234yf" and "R134a" mentioned above, but it can be directly discharged into the environment.

For this reason, maintenance stations used to charge and discharge vehicle air conditioning systems provided with carbon dioxide are generally not equipped with recovery tanks, but they comprise a specific discharging circuit, which is connected to the vehicle air conditioning system in order to expel carbon dioxide into the environment.

However, during the maintenance of the aforesaid conditioning systems, there is the need to know beforehand and with a relatively high precision the amount of carbon dioxide that is actually contained in the air conditioning system of the vehicle, so as to be able to diagnose possible fault conditions of the system, for example caused by gas leaks.

An indirect method to determine the aforesaid amount consists in measuring the carbon dioxide discharged by the maintenance apparatus from the air conditioning system into the environment.

However, there is an actual technical difficulty in measuring the carbon dioxide discharged from the air conditioning system, as the pressures we are dealing with are extremely high, usually ranging from 130 to 170 bar. Therefore, the measuring devices generally installed in the charging stations using traditional cooling fluids "R1234yf" and "R134a" have proven to be unsuitable to be used to carry out the aforesaid measurement in carbon dioxide systems.

Furthermore, during the discharge, there is a quick and uncontrolled reduction of the pressure of the carbon dioxide, which can cause the formation of dry ice in the ducts where it flows, thus causing obstructions that, besides preventing it from being discharged, invalidate the measurement.

Patent application US 2016/0123641 A1 describes a maintenance apparatus in which the discharging circuit comprises a plurality of discharging lines arranged in parallel to one another, each connected between an inlet and the atmosphere and comprising a corresponding opening and a discharging valve. The maintenance apparatus further comprises a timer and a controller, which estimates a theoretical value indicating the theoretical mass flow rate of carbon dioxide passing through each discharging line based on the duration of the relative discharge, determined by the timer, and on the dimensions of the relative opening, and determines the total discharged mass by adding the estimated theoretical mass flow rates of the discharging lines.

DISCLOSURE OF INVENTION

Therefore, the object of the invention is to provide a maintenance apparatus, which is designed to discharge and charge carbon dioxide from and into an air conditioning system of a motor vehicle and is provided with a system for measuring the amount of carbon dioxide discharged from the air conditioning system, said maintenance apparatus being capable of overcoming the drawbacks described above.

According to the invention there is provided a maintenance apparatus for discharging and charging carbon dioxide from/into an air conditioning system of a motor vehicle according to the appended claims.

According to the invention, there is also an operating method for the aforesaid maintenance apparatus according to the appended claims.

BRIEF DESCRIPTION OF THE DRAWINGS

The invention will now be described with reference to the accompanying drawings, which show a non-limiting embodiment thereof, wherein:

FIG. 2 schematically shows the system for measuring the amount of carbon dioxide discharged from the air conditioning system of a vehicle, which is comprised in the maintenance apparatus shown in FIG. 1; whereas

BEST MODE FOR CARRYING OUT THE INVENTION

The invention will now be described in detail with reference to the accompanying Figures, so as to allow a person skilled in the art to carry it out and to use it. Possible changes to the embodiments described will be immediately evident to skilled people and the generic principles described can be applied to other embodiments and applications without for this reason going beyond the scope of protection of the invention as it is defined in the appended claims. Therefore, the invention cannot be considered as limited to the embodiments described and shown herein, but is has to be associated with the widest scope of protection possible in accordance with the principles and the features described and claimed herein.

Figure 1:
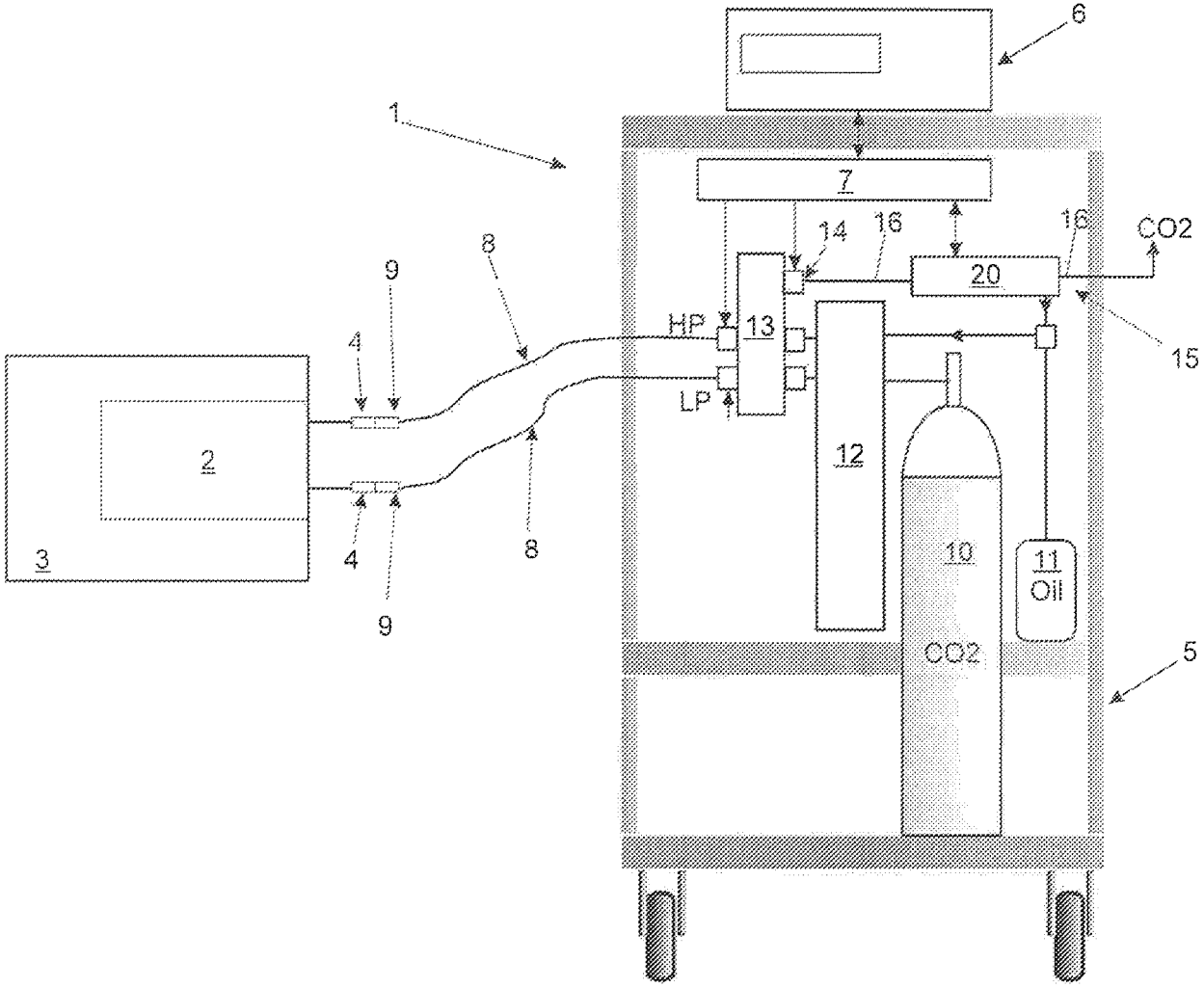
FIG. 1 is a schematic front elevation view, with sectional parts and parts removed for greater clarity, of a maintenance apparatus designed to discharge and charge carbon dioxide from/into an air conditioning system of a vehicle according to the invention.

With reference to FIG. 1, number 1 indicates, as a whole, a maintenance system, namely a machine or apparatus designed to discharge and/or charge, upon command, carbon dioxide from/into an air conditioning system 2 mounted on a motor vehicle 3, such as for example a terrestrial vehicle, in particular a car (schematically shown in FIG. 1).

In the example shown in FIG. 1, the vehicle air conditioning system 2 has at least two terminals/connectors 4, one of them being able to be associated with a first "high" pressure circuit branch (not shown) of the air conditioning system 2, whereas the other terminal 4 can be associated with a second "low" pressure circuit branch (not shown) of the air conditioning system 2. The pressure of the carbon dioxide in the first "high" pressure circuit branch of the air conditioning system 2 can be comprised in the pressure interval ranging from around 150 to around 170 bar, whereas the pressure in the second "low" pressure circuit branch can be comprised in the pressure interval ranging from around 90 to around 100 bar. Obviously, for the purpose of the invention, the term air conditioning system 2 indicates a system mounted on board a vehicle, which is designed to fulfil an air "conditioning" function inside the passenger compartment of the vehicle 3.

According to a preferred embodiment shown in FIG. 1, the maintenance apparatus 1 can comprise: a box-like frame or outer casing 5, which is preferably—though not necessarily—provided with wheels to lay the maintenance apparatus 1 on the ground and allow it to be moved on a surface, a control panel 6, which is configured to allow a user to display data and/or give orders to the maintenance apparatus 1, and an electronic control unit 7, which is designed to control the electric/electronic devices/components of the maintenance apparatus 1 during the discharging and charging operations of the carbon dioxide from/into the air conditioning system 2.

The apparatus 1 can comprise, furthermore, a series of external connection pipes or ducts 8 (two of them are shown in the example in FIG. 1), preferably flexible, which are provided—at the relative ends—of connectors/terminals 9, which can manually be coupled, in a stable though easily removable manner, to the two terminals 4 associated with the first high pressure branch and with the second low pressure branch of the air conditioning system 2.

According to a preferred embodiment, the maintenance apparatus 1 can comprise, furthermore, a tank 10 containing carbon dioxide at a predetermined pressure and a tank 11, which is designed to contain lubricating oil that, is use, is added to/mixed with the carbon dioxide during the charging operation thereof into the air conditioning system 2.

According to an embodiment shown in FIG. 1, the maintenance apparatus 1 comprises, furthermore, at least one charging unit 12, which is designed to be selectively connected to the tank 10 and/or to the tank 11 and/or to the external ducts 8 through hydraulic branches and/or by means of one or more solenoid valves, so as to feed/charge into the air conditioning system 2, through the ducts 8, a given amount of carbon dioxide provided by the tank 10, preferably with the addition of a predetermined amount of lubricating oil from the tank 11.

In the example shown, the charging unit 12 is designed to be selectively connected to the tank 10 and/or to the tank 11 and/or to the external ducts 8 through a common manifold, namely a distributor device 13, which has a plurality of inlets/outlets hydraulically communicating with one another through suitable ducts, and preferably comprises a series of solenoid valves 14, which are designed to open/close each inlet/outlet of the distributor device 13 under the control of the electronic control unit 7.

The charging unit 12 is known and, as it is not part of the subject-matter of the invention, it will not be further described herein. As far as the distributor device 13 is concerned, it can be structured so as to have two inlets 8, which are connected to the two ducts 8, and an outlet 13*a*, which is hydraulically connected to both inlets through relative ducts, so as to receive, in use, the high pressure carbon dioxide provided by the first branch of the system 2 and, at the same time, the low pressure carbon dioxide supplied by the second branch of the air conditioning system 2. Therefore, the distributor device 13 is designed to provide, at the outlet 13*a*, a flow of carbon dioxide having a first pressure P1 and a first flow rate Q1.

Obviously, the invention is not limited to the use of the distributor device 13 described above and shown in FIG. 2, but it can involve the use of any type of hydraulic circuit that is structured so as to receive, in use, both the high pressure carbon dioxide provided by the first branch of the air conditioning system 2 and the low pressure carbon dioxide of the second branch of the air conditioning system 2 and conveys the two flows (a high pressure one and a low pressure one) through a preferably common outlet circuit/duct, where the pressure and the flow rate of the flow of carbon dioxide are equal to the first pressure P1 and to the first flow rate Q1, respectively.

Figure 2:
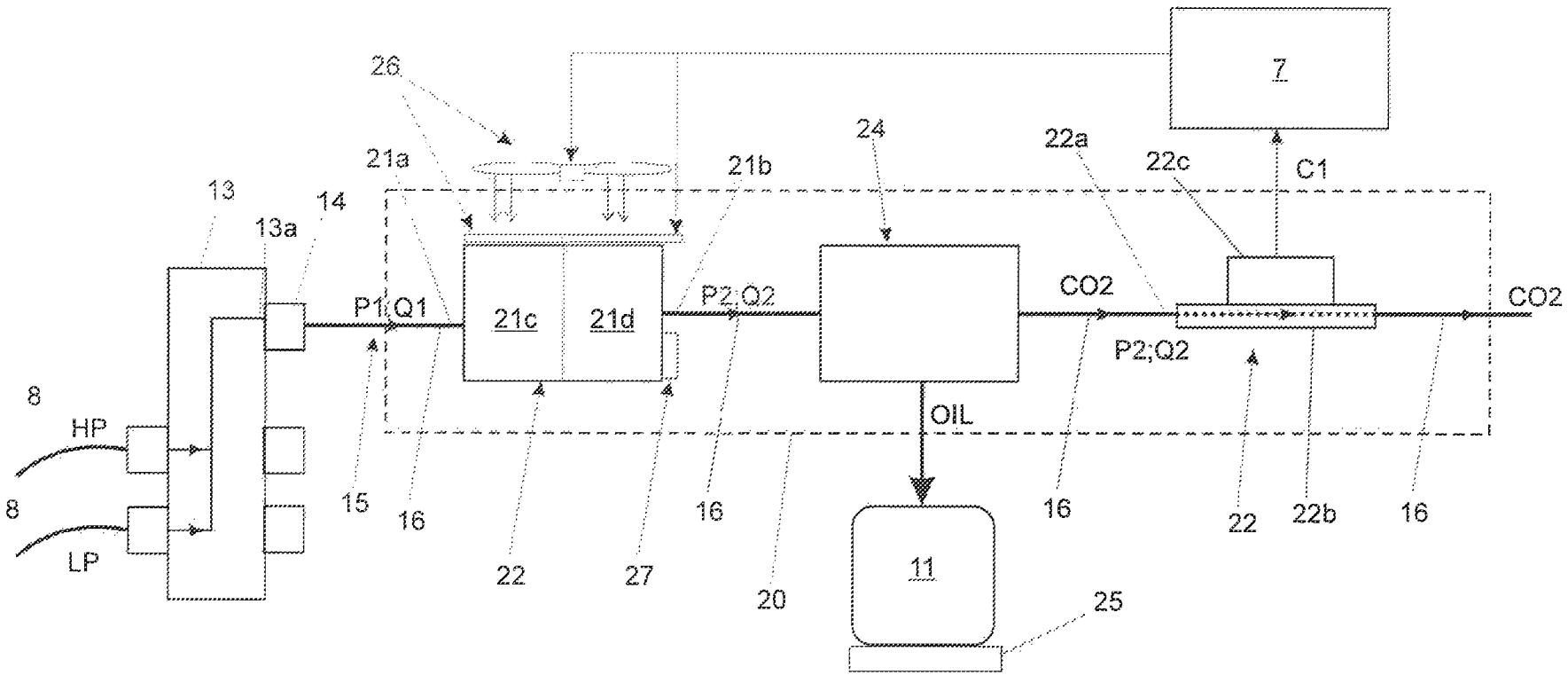

With reference to FIGS. 1 and 2, the maintenance apparatus 1 comprises, furthermore, a discharging circuit 15, which, in use, is designed to discharge the carbon dioxide contained in the air conditioning system 2 towards the external environment.

According to a preferred embodiment shown in FIG. 2, the discharging circuit 15 can comprise at least one discharging duct 16, which can be connected, on one side, for example, to the outlet 13*a* of the distributor device 13 (if present), from which it receives the flow of carbon dioxide having the first pressure P1 and the first flow rate Q1 and, on the other side, discharges the flow of carbon dioxide into the environment.

With reference to FIGS. 1 and 2, the maintenance apparatus 1 comprises, furthermore, a measurement system 20, which is associated with the discharging circuit 15 and is configured so as to supply to the electronic control unit 7 an electric/electronic signal C1, which indicates the amount of carbon dioxide discharged from the system 2 into the environment through the discharging circuit 15.

On the other hand, the electronic control unit 7 can be configured to determine the quantity of carbon dioxide discharged from the air conditioning system 2 towards the environment based on the electric signal C1.

According to a preferred embodiment, the measurement system 20 basically comprises a pressure and flow rate reducing device 21 and an electronic measuring apparatus 22, which are associated with the discharging duct 16.

According to a preferred embodiment shown in FIG. 2, the pressure and flow rate reducing device 21 is arranged along the discharging duct 16 and is structured so as to reduce the first pressure P1 and the first flow rate Q1 of the flow of carbon dioxide passing through the discharging duct 16 to a second predetermined pressure P2 and to a second predetermined flow rate Q2, respectively.

As far as the electronic measuring apparatus 22 is concerned, according to a preferred embodiment shown in FIG. 2, it is arranged along the discharging duct 16 downstream of the pressure and flow rate reducing device 21 and has an inlet 22*a*, which receives the flow of carbon dioxide having the second pressure P2 and the second flow rate Q2 and is configured so as to supply the signal C1 to the electronic control unit 7.

According to a preferred embodiment shown in FIG. 2, the pressure and flow rate reducing device 21 can have at least one inlet 21*a*, which is preferably connected to the outlet 13*a* of the distributor device 13 to receive, in use, the flow of carbon dioxide having the first pressure P1 and the first flow rate Q1, and an outlet 21*b*, which is hydraulically connected to the inlet 22*a* of the electronic measuring device 22 to supply to the latter the flow of carbon dioxide having the second pressure P2, which is smaller that the first pressure P1, and the second flow rate Q2, which is smaller than the first flow rate Q1.

According to a preferred embodiment shown in FIG. 2, the pressure and flow rate reducing device 21 comprises a double stage adjusting device constituted by a pressure reduction stage 21*c* and a flow rate reduction stage 21*d*. The pressure reduction device 21*c* has a fluidic connection to the inlet 21*a* to receive, during the discharging operation, the flow of carbon dioxide having the first pressure P1 and the first flow rate Q1, and is structured so as to reduce the first pressure P1 to the second pressure P2, is order to supply, at the outlet, the flow having the second pressure P2 and the first flow rate Q1. Preferably, the second pressure P2 of the flow of carbon dioxide flowing out of the pressure reduction stage 21*a* can be comprised between around 10 Bar and around 15 Bar, preferably 12 Bar.

As far as the flow rate reduction stage 21*d* is concerned, it is arranged downstream of the pressure reduction stage 21*c*, has an inlet, which is fluidically connected to the outlet of the pressure reduction stage 21*c* and is structured so as to: receive from the pressure reduction stage 21*c* the flow of carbon dioxide having the second pressure P2 and the first flow rate Q1, adjust the flow so as to reduce the flow rate to the second flow rate Q2, and supply, at the outlet 21*b*, the flow of carbon dioxide having the second pressure P2 and the second flow rate Q2. Preferably, the flow rate reduction stage 21*d* is structured so as to make sure that the second flow rate Q2 of the flow of carbon dioxide supplied at the outlet 21*b* ranges from around 60 (litres/minute) to approximately 70 (litres/minute), preferably 62 (litres/minute).

The Applicant found out that the double-stage pressure and flow rate reducing device advantageously allows manufacturers to increase the stability both of the pressure and of the flow rate of the flow of carbon dioxide supplied at the inlet 22*a* of the electronic measuring device 22 and, therefore, to obtain an increase in the measurement precision thereof.

The Applicant further found out that the double-stage pressure and flow rate reducing device advantageously eliminates, during the discharging operation, the risk of formation of dry ice in the ducts where the discharged carbon dioxide flows.

It should be pointed out that tests carried out by the Applicant showed that the use of a sole "single-stage" pressure reducing device upstream of the electronic measuring device 22 is not suited to avoid the formation of ice. As a matter of fact, when carbon dioxide flows through the "single-stage" pressure reducing device, it is subjected to a significant pressure reduction within a very small time interval. This sudden reduction determines an adiabatic expansion of the carbon dioxide, which quickly lowers the temperature of the carbon dioxide itself and causes, in the latter, a change of state from the gas state to the solid state. Therefore, the use of a sole "single-stage" pressure reducing device does not solve the technical problem of the formation of dry ice.

As far as the electronic measuring apparatus 22 is concerned, it has the inlet 22*a*, which is preferably connected to the outlet of the pressure and flow rate reducing means 21 so as to receive the flow of carbon dioxide having the second pressure P2 and the second flow rate Q2, and an outlet, which is connected to an end portion of said discharging duct 16, through which the carbon dioxide discharged from the conditioning system 2 is expelled into the environment.

According to the embodiment shown in FIG. 2, the electronic measuring apparatus 22 can comprise a measurement duct 22*b*, which, in use, can at least partially house the flow of carbon dioxide supplied at the outlet by the pressure and flow rate reducing device 21, and an electronic sensor and/or an electronic measurement circuit 22*c*, which is designed to measure at least one physical parameter associated with the amount of carbon dioxide passing through the measurement duct 22*b*. The electronic measurement circuit 22*c* can comprise, for example, an electronic flow measuring sensor, which is configured so as to measure the mass of carbon dioxide passing through the measurement duct 22*b* and to generate the electric signal C1 based on the measured mass.

Obviously, the invention is not limited to an electronic measurement circuit 22*c* provided with an electronic flow measuring sensor, but it can involve the use of any sensor capable of providing a signal C1 indicating/correlated with the amount of carbon dioxide discharged through the discharging duct. For example, according to a different embodiment, the measurement duct 22*b* can be a by-pass duct, which is fluidically connected in parallel to the discharging duct 16, and the electronic measurement circuit 22*c* can comprise a thermal sensor, which is configured to generate the signal C1, for example based on a difference of temperature of the carbon dioxide measured between two points spaced apart along the measurement duct 22*b*. It should be pointed out that, as a matter of fact, the amount of carbon dioxide is correlated with the difference of the temperature of the gas measured in two points of the discharging duct 16 located at a predetermined distance from one another.

According to a preferred embodiment, the measurement system 20 can further comprise an oil separator device 24, which is arranged along the discharging duct 16, preferably between the outlet 21*b* of the pressure and flow rate reducing device 21 and the inlet of the electronic measuring apparatus 22. The oil separator device 24 can comprise at least one filtering organ, for example a filter, which, during the discharging operation, filters/separates the lubricating oil from the carbon dioxide, so as to feed, on one side, the separated oil into the tank 11 and so as to supply, on the other side, the filtered/clean carbon dioxide (i.e. without the lubricating oil) to the inlet of the electronic measuring device 22.

The Applicant found out that the use of the oil separator device 24 allows the particles of oil discharged from the vehicle air conditioning system together with the carbon dioxide to be eliminated before the electronic measuring apparatus 22, thus increasing the reading precision thereof.

According to a preferred embodiment shown in FIG. 2, the measurement system 20 can further conveniently comprise measuring means 25, which are designed to supply to the electronic control unit 7 a quantity/electric signal, which indicates the quantity of oil separated from the carbon dioxide during the discharging operation thereof from the system 2. The measuring means 25 can comprise, for example, electronic load cells, which measure the weight of the tank 11, and/or flow meters, which are arranged along a duct, which fluidically connects an outlet of the filter of the oil separator device 24 to the inlet of the tank 11.

The electronic control unit 7 can process the measured amount of oil so as to determine the amount of (new) oil to be injected into the air conditioning system 2 undergoing maintenance, namely to be fed during the next charging operation.

According to a preferred embodiment shown in FIG. 2, the measurement system 20 can further comprise heating means 26, which are designed to supply heat to the pressure and flow rate reducing device 21, so that the temperature of the carbon dioxide flowing inside the latter is kept within a predetermined temperature interval. Studies carried out by the Applicant have shown, indeed, that the optimal temperature of the carbon dioxide flowing through the adjusting device 21 with a pressure of 60 Bar and a flow rate of 60 litres/minute can range from around 5° C. to around −15° C.

According to a preferred embodiment shown in FIG. 2, the heating means 26 can be controlled by the electronic control unit 7—preferably, though not necessarily—based on the measured temperature of the carbon dioxide. To this aim, the apparatus 1 can comprise at least one temperature sensor 27, which is arranged, for example, along the discharging duct 16 and/or in the measurement system 20. According to a preferred embodiment shown in FIG. 2, the heating means 26 can comprise a rotary fan, which is caused to rotate by an electric motor, so as to suck air from the environment and generate a flow of air towards the pressure and flow rate reducing device 21, and/or electric/electronic heating components (comprising, for example, resistor circuits), which can be arranged in the area of or, alternatively or in addition, can be integrated in the flow rate reducing device 21.

Preferably, the heating means 26 can be controlled so as to cause the temperature of the carbon dioxide passing through the adjusting device 21 to range from around 5° C. to around −15° C.

The Applicant found out that the heating means 26 are extremely advantageous, as they completely eliminate the risk of formation of dry ice.

Figure 3:
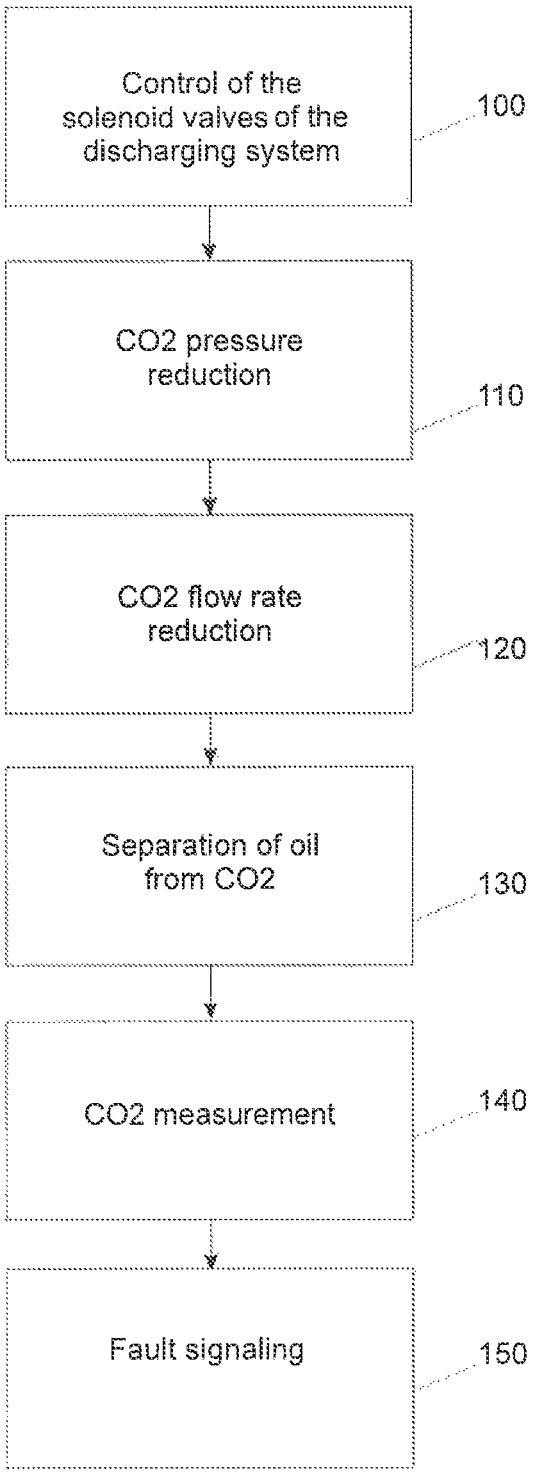
FIG. 3 is a flowchart containing the operations implemented by the operating method of the maintenance apparatus shown in FIG. 1.

FIG. 3 shows a flowchart of the operations implemented by the operating method of the maintenance apparatus 1 during the discharging operation carried out to discharge the carbon dioxide from the air conditioning system 2.

At first, the electronic control unit 7 can preferably selectively control the solenoid valves 14 of the distributor device 13 in such a way that the two inlets of the distributor device 13, which are connected to the two ducts 8, are fluidically connected to the outlet 13*a* (block 100). During this step, the high pressure flow of carbon dioxide supplied by the first branch of the air conditioning system 2 and, at the same time, the low pressure flow of carbon dioxide supplied by the second branch of the system flow together into the outlet 13*a* of the distributor device 13.

According to the method, the carbon dioxide generated by the outlet 13*a* flows into the pressure and flow rate reducing device 21 so as to reduce, through the pressure reduction stage 21*c*, the first pressure P1 of the incoming flow to the second pressure P2 (block 110) and so as to reduce, through the flow rate reduction stage 21*d*, the first flow rate Q1 to the second flow rate Q2 (block 120).

Furthermore, the method preferably—though not necessarily—comprises the step of causing the carbon dioxide to flow through the oil separator device 24, so as to make sure that the oil contained in the carbon dioxide to be discharged is separated/filtered and collected in the tank 11 and, at the same time, the filtered carbon dioxide is supplied to the inlet 22*a* of the electronic measuring apparatus 22 (block 130).

The method further comprises, following the pressure and flow rate reduction, the step of measuring a physical parameter (for example, mass and/or temperature) correlated/associated with the amount of carbon dioxide passing through the discharging duct 16, and of determining the discharged amount of carbon dioxide based on the measured parameter (block 140). Preferably, the electronic control unit 7 can be configured to receive from the measuring device 22, in a continuous and/or discrete manner, the signal C1 indicating the amount of carbon dioxide passing through the discharging duct 16, and it calculates, based on said signal C1, the total amount of carbon dioxide discharged from the air conditioning system 2.

Furthermore, the method preferably—though not necessarily—comprises the step of comparing the determined total amount of carbon dioxide with a predetermined nominal amount of carbon dioxide, which is associated with a correct operation condition of the vehicle air conditioning system 2, and of communicating, for example through the user control panel 6, an incorrect operation condition of the system based on the result of the comparison (block 150).

The method can further preferably—though not necessarily—comprise the step of controlling the heating means 26 based on the measured temperature of the carbon dioxide, so as to increase, in a controlled manner, the temperature of the carbon dioxide flowing through the discharging duct 16.

The advantages of the maintenance apparatus described above are evident. Thanks to the double-stage pressure and flow rate reducing device you can stabilize the pressure and the flow rate at optimal values, which allow manufacturers to increase the measurement precision of the electronic measuring apparatus.

Finally, it is clear that the maintenance apparatus and the operating method described above and shown in the Figures can be subjected to changes and variations, without for this reason going beyond the scope of protection of the invention as set forth in the appended claims.

The invention claimed is:

1. Maintenance apparatus (1) for charging and discharging carbon dioxide into/from an air conditioning system (2) mounted on a motor vehicle (3);

said maintenance apparatus (1) comprising:

at least two external ducts (8), which are structured to be connected to said air conditioning system (2) and are designed to be passed through, during a discharging operation or a charging operation of said air conditioning system (2), by a flow of carbon dioxide having a first pressure (P1) and a first flow rate (Q1);

a tank (10) containing carbon dioxide;

a charging unit (12), which is designed to hydraulically connect said tank (10) of carbon dioxide to said at least two external ducts (8) to charge, during the charging operation, a given amount of carbon dioxide into said air conditioning system (2);

a discharging circuit (15), which is provided with a discharging duct (16) and is designed to be hydraulically connected to said ducts (8) to receive the carbon dioxide contained in the air conditioning system (2); the discharging circuit (15) is further structured so as to discharge the carbon dioxide received into the environment through said discharging duct (16);

said maintenance apparatus (1) being characterised in that it comprises:

pressure and flow rate reduction means (21), which are arranged along said discharging duct (16) and are structured so as to reduce the first pressure (P1) and the first flow rate (Q1) of the carbon dioxide to a second predetermined pressure (P2) and, respectively, to a second predetermined flow rate (Q2);

an electronic measuring apparatus (22), which is arranged along said discharging duct (16) downstream of the pressure and flow rate reduction means (21) and is configured so as to provide an electric signal (C1) indicating the amount of carbon dioxide that passes through said discharging duct (16);

electronic control unit (7), which are configured so as to determine the amount of carbon dioxide discharged from the air conditioning system (2), through said discharging duct (16), into the environment based on said electric signal (C1).

2. Maintenance apparatus according to claim 1, wherein said electronic measuring apparatus (22) has an inlet (22*a*), which is connected to the outlet of said pressure and flow rate reduction means (21) so as to receive the flow of carbon dioxide having the second pressure (P2) and the second flow rate (Q2), and an outlet, which is connected to an end portion of said discharging duct (16), through which the carbon dioxide discharged from the conditioning system (2) is expelled into the environment.

3. Maintenance apparatus according to claim 1, wherein said electronic measuring apparatus (22) comprises a measurement duct (22*b*) receiving at said inlet (22*a*) said flow of carbon dioxide to be measured, and sensor means (22*c*) associated with said measurement duct (22*b*) and configured so as to measure/determine the amount of carbon dioxide passing through said measurement duct (22*b*).

4. Maintenance apparatus according to claim 3, wherein said sensor means (22*c*) comprise an electronic flow measuring sensor, which is configured so as to measure the mass of carbon dioxide passing through said measurement duct (22*b*) and to generate said electric signal (C1) based on the measured mass.

5. Maintenance apparatus according to claim 3, wherein said measurement duct (22*b*) comprises a by-pass duct, which is fluidically connected in parallel to said discharging duct (16), said sensor means (22*c*) comprising a thermal sensor, which is configured to generate said electric signal (C1) based on a difference of temperature of the carbon dioxide measured between two points spaced apart along said measurement duct (22*b*).

6. Maintenance apparatus according to claim 1, wherein said pressure and flow rate reducing means (21) comprise a double stage reduction device constituted by a pressure reduction stage (21C) and a flow rate reduction stage (21*d*).

7. Maintenance apparatus according to claim 6, wherein the pressure reduction stage (21*c*) is structured so as to: receive at the inlet a flow of carbon dioxide having a first pressure (P1) and a first flow rate (Q1), and supply at the outlet a flow of carbon dioxide having said first flow rate (Q1) and a second pressure (P2) below the first pressure (P1); said flow rate reduction stage (21*d*) being structured so as to: receive from the pressure reduction stage (21*a*) the flow of carbon dioxide having the second pressure (P2) and the first flow rate (Q1), reduce the flow rate to a second flow rate (Q2) below the first flow rate (Q1), and supply at the outlet the flow of carbon dioxide having the second pressure (P2) and the second flow rate (Q2).

8. Maintenance apparatus according to claim 1, wherein the second pressure (P2) is between around 10 bar and around 15 bar, the second flow rate (Q2) is between about 60 litres/minute and about 70 litres/minute.

9. Maintenance apparatus according to claim 1, comprising oil separator means (24), which are arranged along said discharging duct (16) between said pressure and flow rate reduction means (21) and said electronic measuring apparatus (22) and are designed to filter the oil from the carbon dioxide, so as to supply the filtered carbon dioxide to said electronic measuring apparatus (22).

10. Maintenance apparatus according to claim 9, comprising measuring means (25), which are configured to supply to said electronic control unit (7) a quantity/electric signal indicating the amount of oil separated from the carbon dioxide by means of said oil separator means (24); said electronic control unit (7) being configured so as to determine the amount of oil to be fed into said air conditioning system (2) based on the amount of oil measured by said measuring means (25).

11. Maintenance apparatus according to claim 9, comprising an oil tank (11), which is designed to contain lubricating oil; said oil separator means (24) comprise at least one filtering organ to filter/separate the lubricating oil from the carbon dioxide so as to feed, on the one hand, the separated oil into said oil tank (11) and so as to supply, on the other hand, the filtered carbon dioxide to the inlet of the electronic measuring apparatus (22); said measuring means (25) comprise electronic load cells, which measure the weight of said oil tank (11), and/or flow meters, which are arranged along a duct that fluidically connects an outlet of said filter of the oil separator means (24) to said oil tank (11).

12. Operating method of a maintenance apparatus (1) designed to charge and discharge carbon dioxide into/from an air conditioning system (2) mounted on a motor vehicle (3); wherein said maintenance apparatus (1) comprises:

at least two external ducts (8), which are structured to be connected to said air conditioning system (2) and are designed to be passed through, during a discharging operation or a charging operation of said air conditioning system (2), by a flow of carbon dioxide having a first pressure (P1) and a first flow rate (Q1);

a tank (10) containing carbon dioxide;

a charging unit (12), which is designed to hydraulically connect said tank (10) of carbon dioxide to said ducts (8) to charge, during the charging operation, a given amount of carbon dioxide into said air conditioning system (2);

a discharging circuit (15), which is provided with a discharging duct (16), is designed to be hydraulically connected to said ducts (8) to receive the carbon dioxide contained in the air conditioning system (2) and is structured so as to discharge, during the discharging operation, the carbon dioxide received into the environment through said discharging duct (16);

said method being characterised in that it comprises the steps of reducing, by means of pressure and flow rate reduction means (21) arranged along said discharging duct (16), the first pressure (P1) and the first flow rate (Q1) of the carbon dioxide to be discharged to a second predetermined pressure (P2) and, respectively, to a second predetermined flow rate (Q2);

measuring, along said discharging duct (16) downstream of said pressure and flow rate reduction means (21), a physical parameter correlated/associated with the amount of carbon dioxide passing through said discharging duct (16), and determining the discharged amount of carbon dioxide based on said measured physical parameter.

13. Method according to claim 12, comprising the step of reducing the pressure and the flow rate of the carbon dioxide along said discharging duct (16) through a two-stage reduction device constituted by a pressure reduction stage (21C) and a flow rate reduction stage (21*d*).

14. Method according to claim 12, wherein the electronic measuring apparatus (22) comprises a measurement duct (22*b*), which receives at the inlet (22*a*) said flow of carbon dioxide to be measured;

said method comprising the step of measuring/determining the amount of carbon dioxide passing through said measurement duct (22*b*) through sensor means (22*c*) associated with the measurement duct (22*b*).

15. A method according to claim 12, comprising the step of filtering/separating the oil from the carbon dioxide by means of oil separator means (24), which are arranged along said discharging duct (16) between said pressure and flow rate reduction means (21) and said electronic measuring apparatus (22).

* * * * *